US009517496B2

(12) United States Patent
Kane et al.

(10) Patent No.: US 9,517,496 B2
(45) Date of Patent: Dec. 13, 2016

(54) FIRE-TUBE BOILER CLEANER

(71) Applicant: Crossford International, LLC, Stamford, CT (US)

(72) Inventors: Timothy J. Kane, Greenwich, CT (US); George Cruz, Norwalk, CT (US); David L. Walsh, Stamford, CT (US)

(73) Assignee: Crossford International, LLC, Stamford, CT (US)

( * ) Notice: Subject to any disclaimer, the term of this patent is extended or adjusted under 35 U.S.C. 154(b) by 0 days.

(21) Appl. No.: 14/939,188

(22) Filed: Nov. 12, 2015

(65) Prior Publication Data

US 2016/0221051 A1 Aug. 4, 2016

Related U.S. Application Data

(60) Provisional application No. 62/122,209, filed on Oct. 14, 2014.

(51) Int. Cl.
*B08B 9/043* (2006.01)
*F28G 1/02* (2006.01)

(52) U.S. Cl.
CPC ..... *B08B 9/0436* (2013.01); *F28G 1/02* (2013.01); *A46B 2200/3013* (2013.01)

(58) Field of Classification Search
CPC ..... B08B 9/00; B08B 9/02; B08B 9/027; B08B 9/04; B08B 9/043; B08B 9/0436; F28G 1/00; F28G 1/02; F28G 1/14; F28G 3/00; F28G 3/04; E03F 9/002; E03F 9/005; E03C 1/302; A46B 2200/3013
USPC ..... 15/104.05, 104.09, 104.095, 104.11, 15/104.16, 104.2, 104.31, 104.33; 122/379; 165/95
See application file for complete search history.

(56) References Cited

U.S. PATENT DOCUMENTS

| | | | | |
|---|---|---|---|---|
| 679,723 A | | 8/1901 | Casaday | |
| 1,538,698 A | | 5/1925 | Hall | |
| 2,219,555 A | * | 10/1940 | Burwell | B08B 9/0436 15/104.05 |
| 2,488,490 A | * | 11/1949 | Buchmiller | B65H 51/18 15/104.33 |

(Continued)

FOREIGN PATENT DOCUMENTS

| | | |
|---|---|---|
| GB | 380435 | 9/1935 |
| GB | 1062393 | 3/1967 |

(Continued)

OTHER PUBLICATIONS

International Search Report for PCT/US2015/060338 dated May 19, 2016; 2 pps.
Written Opinion for PCT/US2015/060338 dated May 19, 2016; 4 pps.

*Primary Examiner* — Mark Spisich
(74) *Attorney, Agent, or Firm* — Carson C.K. Fincham; Fincham Downs, LLC

(57) ABSTRACT

A tube cleaning machine in which cleaning interior tube surfaces occurs by a forward non-cleaning pass of cleaning implement through work tube followed by reverse cleaning pass where implement engages and cleans interior surface. Cleaning implement has first position for forward pass producing minimum engagement of interior fire-tube surface, and a second position for reverse pass of full cleaning engagement with interior fire-tube surface. A distance indicator enables operator to select distance of forward pass of cleaning implement to correspond with tube length.

4 Claims, 10 Drawing Sheets

(56) References Cited

U.S. PATENT DOCUMENTS

| | | | | | |
|---|---|---|---|---|---|
| 2,800,289 | A | * | 7/1957 | Stamm, Jr. | F41A 29/02 15/104.16 |
| 3,078,486 | A | * | 2/1963 | Casto | E03F 9/005 15/104.33 |
| 3,354,490 | A | | 11/1967 | Masters | |
| 3,585,076 | A | * | 6/1971 | Prange | A45B 5/00 134/113 |
| 4,546,519 | A | * | 10/1985 | Pembroke | B08B 9/045 15/104.33 |
| 4,914,776 | A | | 4/1990 | Kaye | |

FOREIGN PATENT DOCUMENTS

| | | |
|---|---|---|
| RU | 2003108401 | 11/2004 |
| SU | 57508 | 11/1939 |
| SU | 950454 | 8/1982 |

* cited by examiner

FIRE-TUBE BOILER CLEANER

CROSS-REFERENCE TO RELATED APPLICATIONS

The present application is a Non-provisional of, and claims benefit and priority to, U.S. Provisional Patent Application No. 62/122,209 filed on Oct. 14, 2014, the entirety of which is hereby incorporated by reference herein.

BACKGROUND

Embodiments disclosed herein generally relate to fire-tube boilers and provide solutions to the problem of cleaning the interior surface of fire-tubes with a lighter weight, easier to use machine.

The general construction of a fire-tube boiler is a tank of water penetrated by tubes that carry the hot flue gases from the boiler's combustion chamber. The tank is usually cylindrical for the most part (being the strongest practical shape for a pressurized container) and this cylindrical tank may be either horizontal or vertical. In a fire-tube boiler a large number of fire-tubes are arranged in a boiler drum for generating a large amount of steam (hot water) for its size as compared to flue boilers. Hot combustion gases pass through fire-tubes running through the sealed boiler drum containing water. The heat of the gases is transferred to the water through the walls of the tubes ultimately creating steam. The many small tubes offer far greater heating surface area for the same overall boiler volume. In operation, surface area heat transfer efficiency is diminished by buildup on the fire-tube interior surfaces by products of corrosion, oxidation, soot, and chemical reactions. Fire-tube boiler cleaning machines are available for tube cleaning, however, such machines are very heavy and hard to use in tight spaces or on elevated catwalks, platforms, or scaffolding. Machine weight is determined by the physics of pushing a rigid cleaning brush in a forward stroke down the full length of a tube by means of a steel tape. The steel tape needs to be thick and heavyweight to resist the significant compressive forces encountered in pushing the brush along the tube. Additionally, the machine needs sufficient mass (weight) to withstand the high loads developed on the brush forward stroke.

Some embodiments disclosed herein deal with the main problem of conventional fire-tube cleaners, i.e., the weight of the cleaner and component parts. Solutions disclosed herein provide a unique and brilliant way of substituting fire-tube boiler mass for the mass needed by conventional machines to withstand the high loads developed on the brush forward stroke. Embodiments disclosed herein generally, for example, take advantage of boiler mass by providing a machine for tube cleaning on reverse stroke.

SUMMARY

Fire-tube cleaners according to embodiments described herein utilize lightweight, high strength components to propel a unique easy-push, clean on return stroke brush for tube cleaning. Brush design minimizes friction resistance on the forward stroke of the cleaning cycle, thereby substantially reducing compressive force on the tape pushing the brush and eliminating tendency of tape to collapse, buckle, or bind within a tube. On the return cleaning stroke the tape is in constant tension and can easily handle the forces involved. A preferred embodiment is designed for modern package boilers usually having tubes of maximum length of sixteen (16) feet and of outside diameter of two inches (2") to two and one half inches (2½").

An operator of the fire-tube cleaner according to some embodiments pre-sets the distance the tape and brush travel according to boiler tube length thereby allowing the operator to concentrate on machine and cleaning cycle. This feature eliminates operator need to concentrate on machine distance monitor to avoid cleaning brush slamming into the far side of the boiler damaging boiler cover, insulation, cleaning brush, etc.

The machine may also or alternatively include a distance monitor on both sides of the machine, a centrally located rear-mounted operating switch, and a main drive-train of motor, gearbox, clutch, and final drive located within the machine protecting the operator from moving parts and hot (e.g., one hundred and eighty degrees Fahrenheit (180° F.)) exposed drive motor. The machine allows for quick change of steel tape without the need for machine disassembly.

An easy-push, clean on return stroke brush reduces push force through fire-tubes. The brush may be mounted on a restricted movement swivel that allows the brush to fold over passing down the tube, and to setup and remain upright on the return stroke.

Specific examples are included in the following description for purposes of clarity, but various details can be changed within the scope of the present invention.

OBJECTS OF THE INVENTION

An object of the invention is to provide a machine for cleaning tubes.

An object of the invention is to provide a machine for cleaning fire-tubes that cleans tubes on brush return stroke thereby to take advantage of boiler mass and reduce cleaning machine mass.

Another object of the invention is to provide a lightweight fire-tube cleaner with reduced resistance on brush push stroke and with tube cleaning occurring on the return stroke.

Another object of the invention is to provide a fire-tube cleaning machine with lightweight, high strength steel tape to propel brush down the tube.

Another object of the invention is to provide fire-tube cleaning machine with preset travel distance for tape selected according to fire-tube length.

Another object of the invention is to provide for tube cleaning machine with drive train located within the machine for operator protection.

Other and further objects of the invention will become apparent with an understanding of the following detailed description of the invention or upon employment of the invention.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

Figure 1:
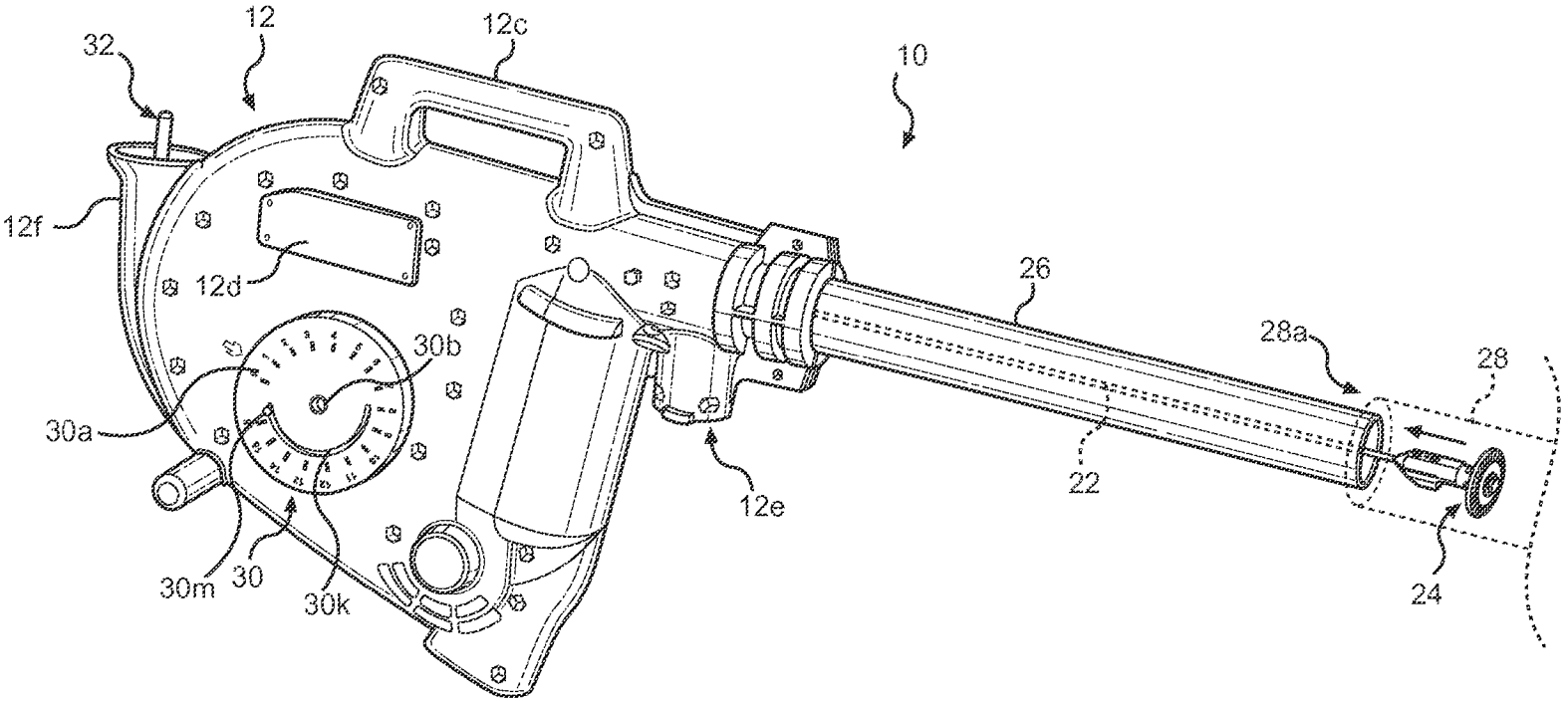
FIG. 1 is a perspective view of a preferred embodiment of a fire-tube cleaner according to some embodiments.
Figure 2:
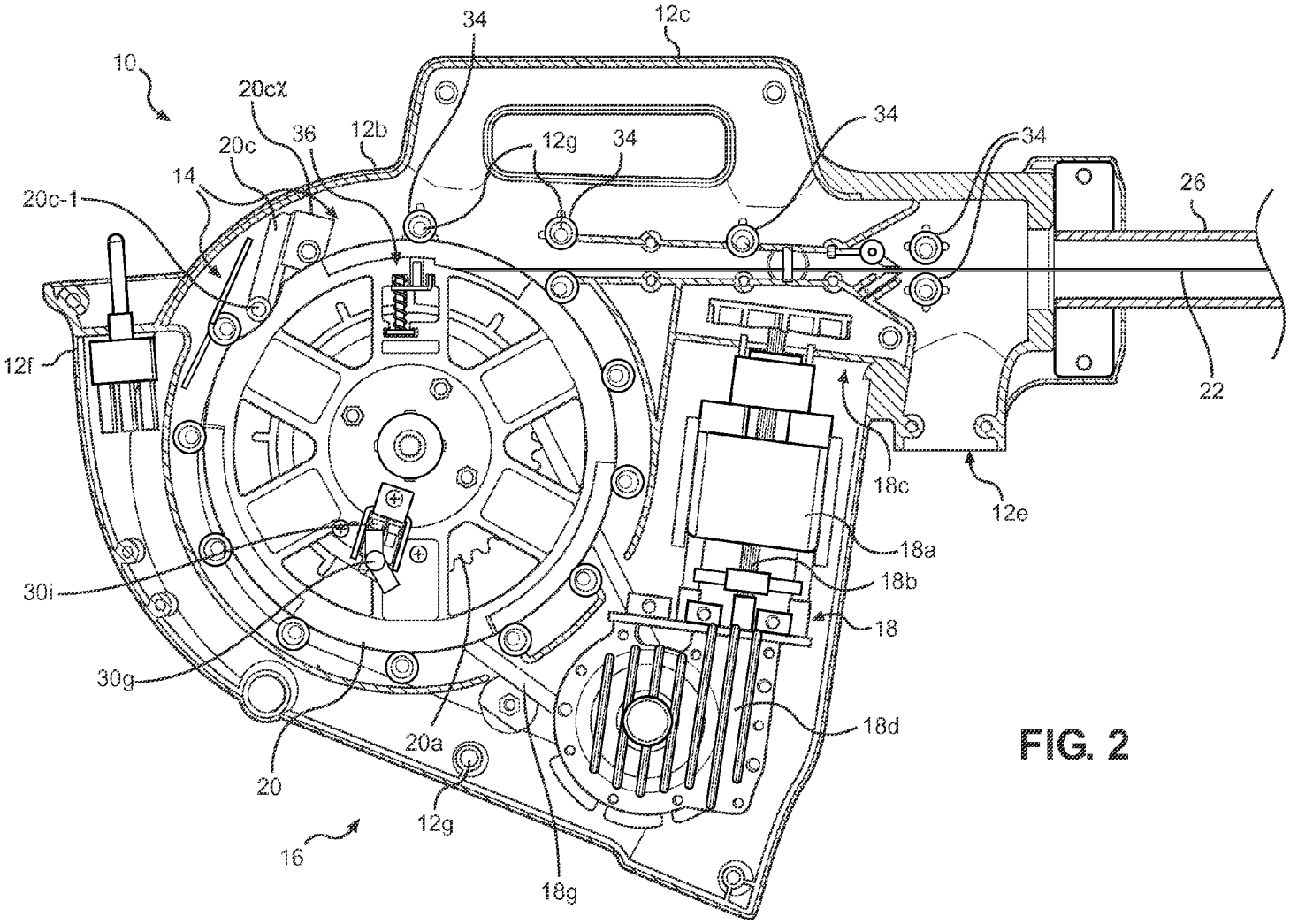
FIG. 2 is a side elevation view of the fire-tube cleaner of FIG. 1 with first side cover plate removed to illustrate interior components.
Figure 3:
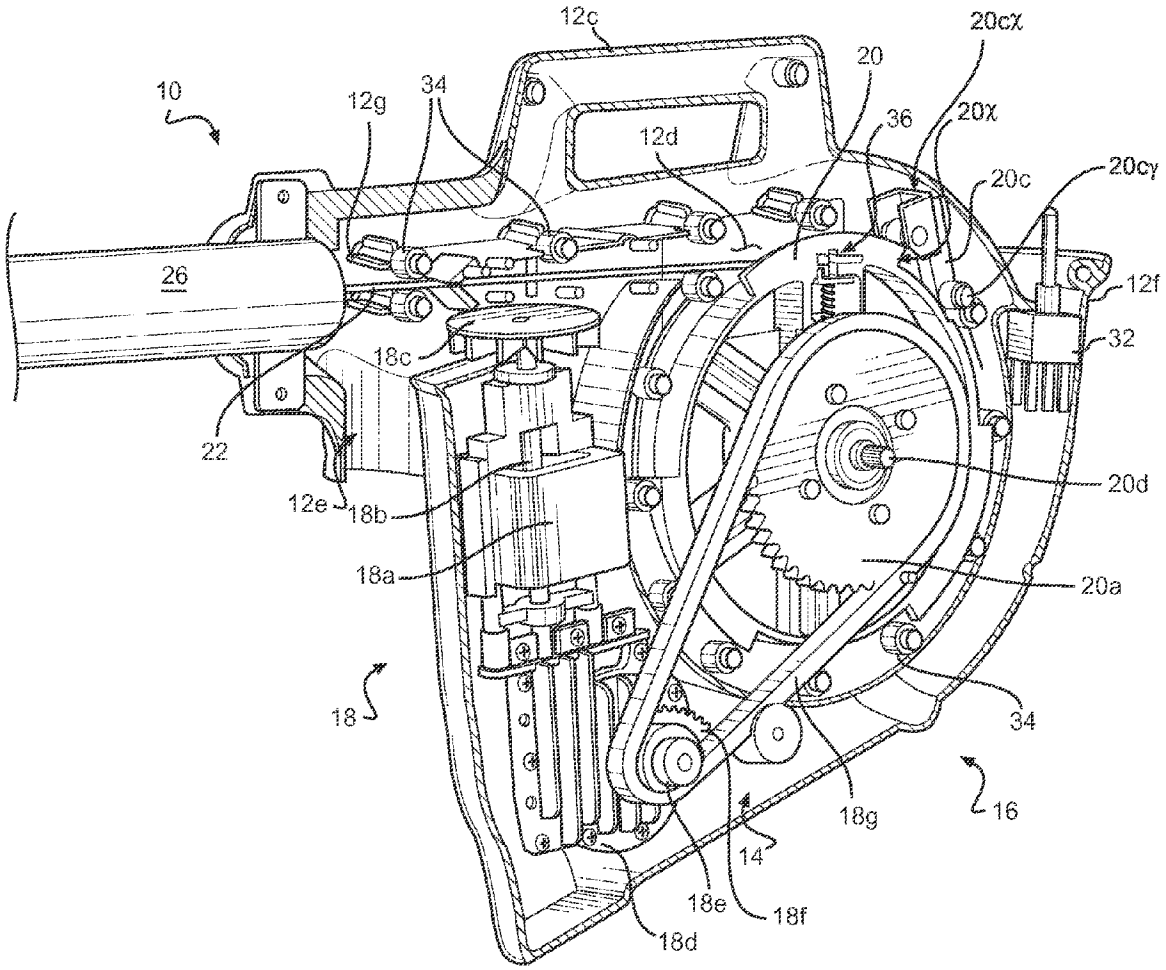
FIG. 3 is a reverse side perspective view of the fire-tube cleaner of FIG. 1 and FIG. 2 with second side cover plate removed to illustrate interior components.

Referring to FIG. 1, FIG. 2, and FIG. 3 of the drawings, a fire-tube cleaning machine 10 includes housing 12 defined by confronting shell members 12*a-b* defining an interior space 14 for placement of cleaner operating components 16 including drive-train 18 and tape reel 20 with drum drive gear 20*a*. The housing further includes carry handle 12*c*, cover plate 12*d* for access to tape anchor 36 (also shown in FIG. 6 and FIG. 7), vacuum connection 12*e*, and cleaner switch console 12*f*. The shell members 12*a-b* are secured to each other by suitable fasteners (not shown) at multiple locations 12*g*.

A tape 22 and brush and/or brush assembly 24 may be housed in a deployment member in the form of a tape outlet barrel 26 that extends from the housing 12 for insertion into individual fire-tubes 28 so as to position tape 22 and brush assembly 24 at tube entry 28*a*. The tape outlet barrel 26 serves as a vacuum conduit for carrying dislodged soot from each tube 28 to a vacuum source (not shown) at vacuum connection 12*e*.

A distance indicator 30 (described in detail below) may be affixed to a side of housing 12 exterior for pre-setting distance of tape travel according to length of boiler fire-tubes 28.

Layout of interior components according to some embodiments is shown in FIG. 2 and FIG. 3 including tape reel 20 with its drive gear 20*a* and tape anchor 36, and tape reel drive train 18.

Drive train 18 may include, for example, an electric drive motor 18*a* suitably powered with drive shaft 18*b* rotating at one end a cooling fan 18*c*, and worm gear box 18*d* at other end. Output pinion 18*f* is positioned between gear box 18*d* and clutch 18*e*. Out-put pinion 18*f* is driven by worm gear (not shown; housed inside of the worm gear box 18*d*) to power drive chain or belt 18*g* for turning tape reel 20 by its drive gear 20*a*. Power switch 32 has forward, center, and reverse positions for directing rotation of the drive motor 18*a*. Tape reel 20 is equipped with a reel stop 20*c* for stopping the reel 20 (e.g., by a stop surface 20*cx* engaging with a stop portion 20*x* of the reel 20, such as by the reel stop 20*c* rotationally engaging therewith by rotating about a stop pivot 20*cy*) so tape holder or anchor 36 may be stopped/located at housing access panel 12*d* (e.g., for access to allow tape changeover and/or maintenance or adjustment).

Figure 4A:
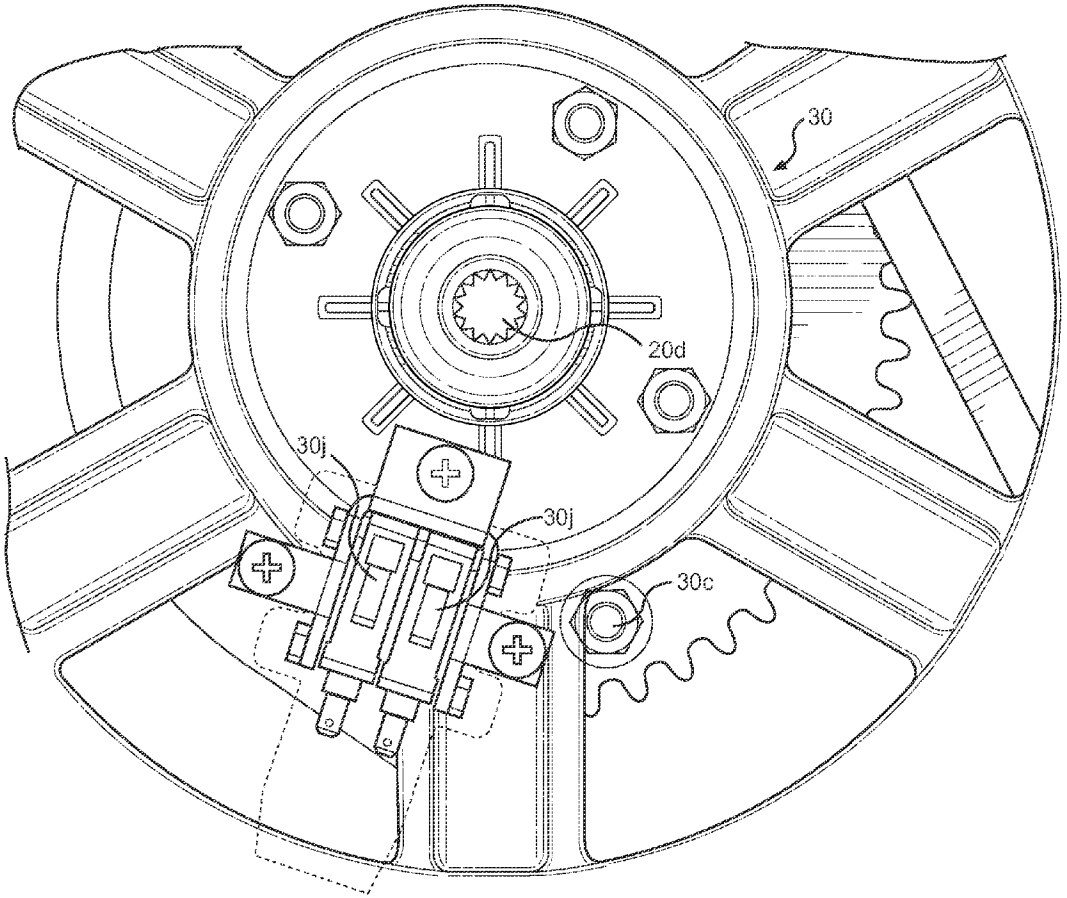
FIG. 4A is fragmentary side view of interior working components of a distance indicator.
Figure 4B:
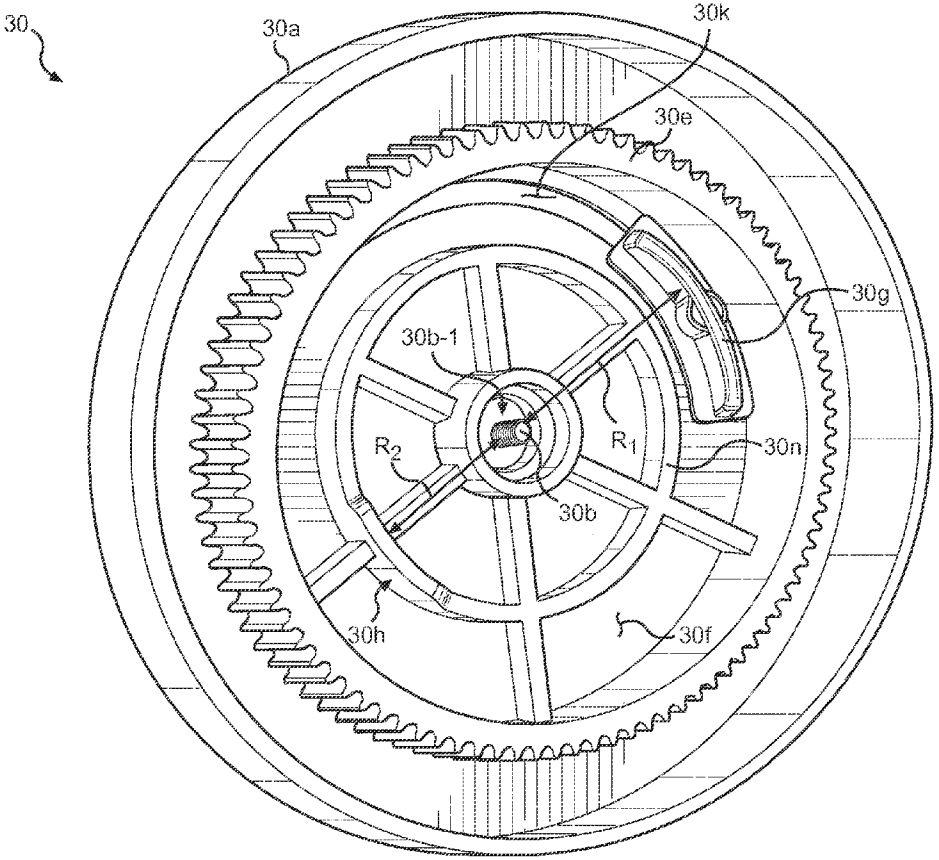
FIG. 4B is a perspective view of interior working components of a distance indicator.

The distance indicator 30 on one or both sides of the housing 12 sets the distance of payout of tape 22 on brush forward stroke according to the length of fire-tubes 28 in a particular boiler (not shown). Referring to FIG. 4A, the distance indicator 30 has a first limit switch 30*i* providing an "off" function for the drive motor 18*a* at the end of a length of tape 22 paid out on forward stroke. The operator uses forward/reverse switch 32 on return stroke to pull tape 22 and brush assembly 24 in a cleaning pass through a fire-tube 28. On return stroke the distance indicator 30 trips a second limit switch 30*j* for providing an "off" function for drive motor 18*a*. A distance adjustment control knob 30*m* (FIG. 1) is movable through an adjustment arc defined by an arced slot 30*k* (FIG. 1 and FIG. 4B) in distance indicator 30 for setting payout distance of the tape 22.

Reel drive gear or sprocket 20*a* is fitted with distance indicator drive pinion 20*d* for powering distance indicator 30. Distance indicator 30 includes outer cover 30*a* secured by retaining bolt 30*b* at socket 30*c* formed in a housing shell member 12*a* or 12*b* with indicator sprocket gear 30*e* (FIG. 4B) meshed with teeth of the distance indicator drive pinion 20*d*. Inner web 30*f* (FIG. 4B) of the indicator sprocket gear 30*e* is provided with a movable forward actuator 30*g* (also shown in FIG. 2 as engaged with first limit switch 30*i*—although with the indicator sprocket gear 30*e* is not shown in FIG. 2) and a stationary or fixed rearward actuator 30*h* cooperating with the first or forward limit switch 30*i* and with the second or rearward limit switch 30*j*, which may for example, comprise micro-switches. Forward actuator 30*g* comprises an arcuate bar at a first fixed radius R1 from sprocket center 30*b*-1 (e.g., coincident with a center axis of the retaining bolt 30*b*), the bar being slidable along the arced slot 30*k* formed in the sprocket web 30*f*. The forward actuator fixed radius R1 is equal to a distance between the sprocket center 30*b*-1 and a contact surface of the first limit switch 30*i*. Forward actuator 30*g* and forward limit switch 30*i* cooperate (e.g., as depicted in FIG. 2) to stop tape 22 and brush assembly 24 forward movement into the fire-tube 28. Rearward actuator 30*h* is affixed to circular rib 30*n* (and/or comprises a raised portion of the circular rib 30*n*) positioned on inner web 30*f* at a second fixed radius R2 from sprocket center 30*b*-1. The second fixed radius R2 is equal to a distance between the sprocket center 30*b*-1 and the rearward limit switch 30*j*.

Figure 5:
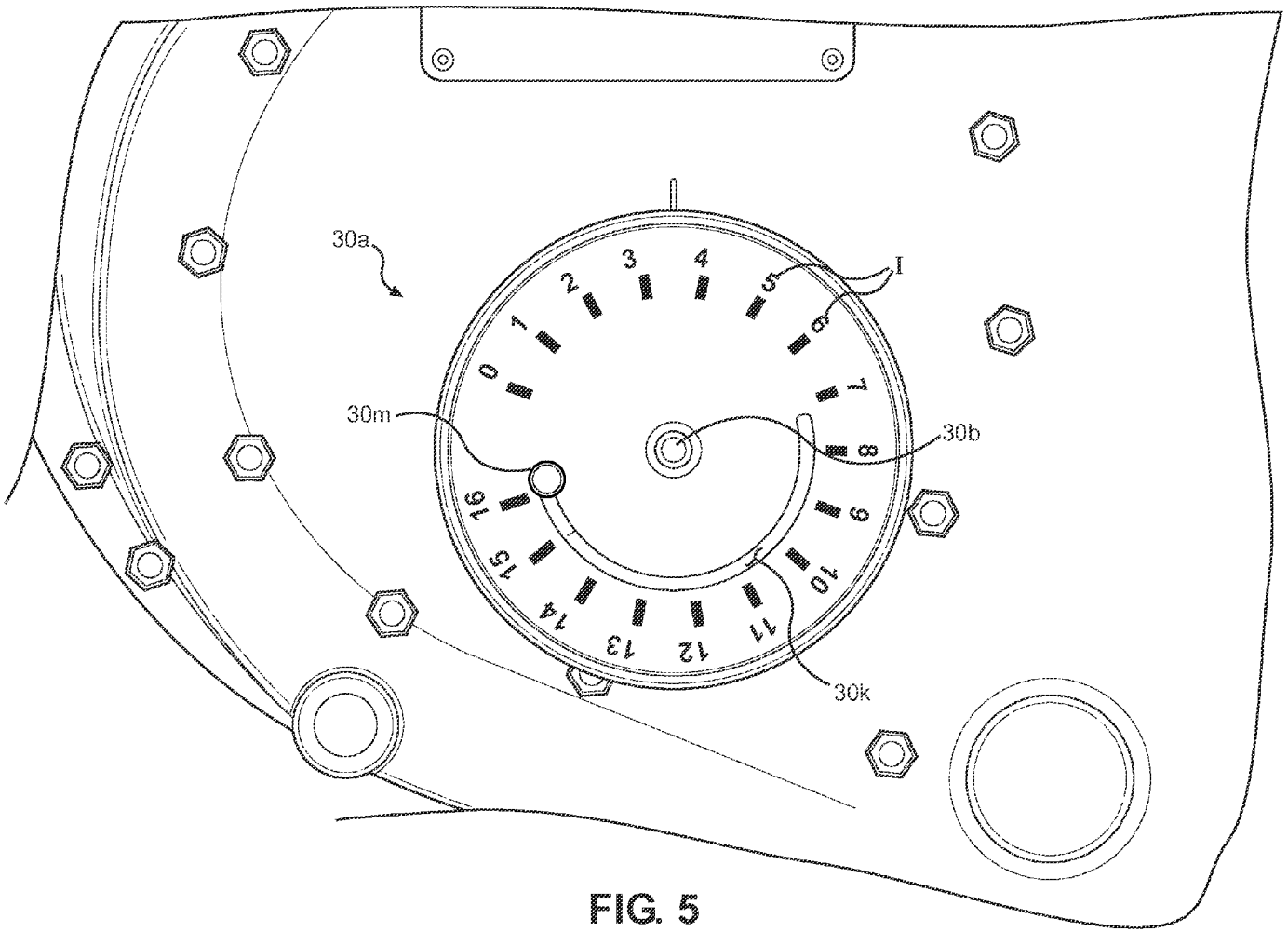
FIG. 5 is a front elevation view of the distance indicator cover shown in FIG. 1 and FIG. 4B.

FIG. 1 and FIG. 5 show distance indicator cover 30*a* with slot 30*k* and indicator knob 30*m*. The distance travelled forward into a tube by tape 22 and brush assembly 24 in a tube cleaning pass is selected by moving knob 30*m* (and accordingly the attached/cooperative forward actuator 30*g*) along slot 30*k*. As shown in FIG. 5, indicator cover 30*a* has indicia "I" arranged along its circumference with a portion of indicia "I", i.e., labels representing numbers/settings seven (7) through sixteen (16), arranged alongside slot 30*k*. The indicia "I" correlates to tube length, and by positioning knob 30*m* adjacent a specific value representing a desired/known tube length, the operator thus selects distance cleaning brush assembly 24 travels on forward stroke. The knob 30*m* has a threaded connection (not shown) with forward actuator 30*g* for tightening forward actuator 30*g* in selected position in the slot 30*k*. In operation, rearward actuator 30*h* stops tape movement when sprocket 20*a* (e.g., via engagement of the distance indicator drive pinion 20*d*) brings the rearward actuator 30*h* into contact with the rearward limit switch 30*j*, as occurs when the tape 22 and brush assembly 24 are withdrawn from a tube 28. Forward movement of tape 22 and brush assembly 24 in another tube 28 occurs with forward actuation of operating switch 32 by machine operator. Forward movement of tape 22 and brush assembly 24 continues for a pre-selected distance corresponding to the dialed-in position of forward actuator 30*g*. Forward movement of tape 22 and brush assembly 24 stops when movable forward actuator 30*g* trips the forward limit switch 30*i*. At this point operator uses main switch 32 to reverse tape 22 and brush assembly 24 movement drawing them rearward in a cleaning pass through a tube 28.

Figure 6:
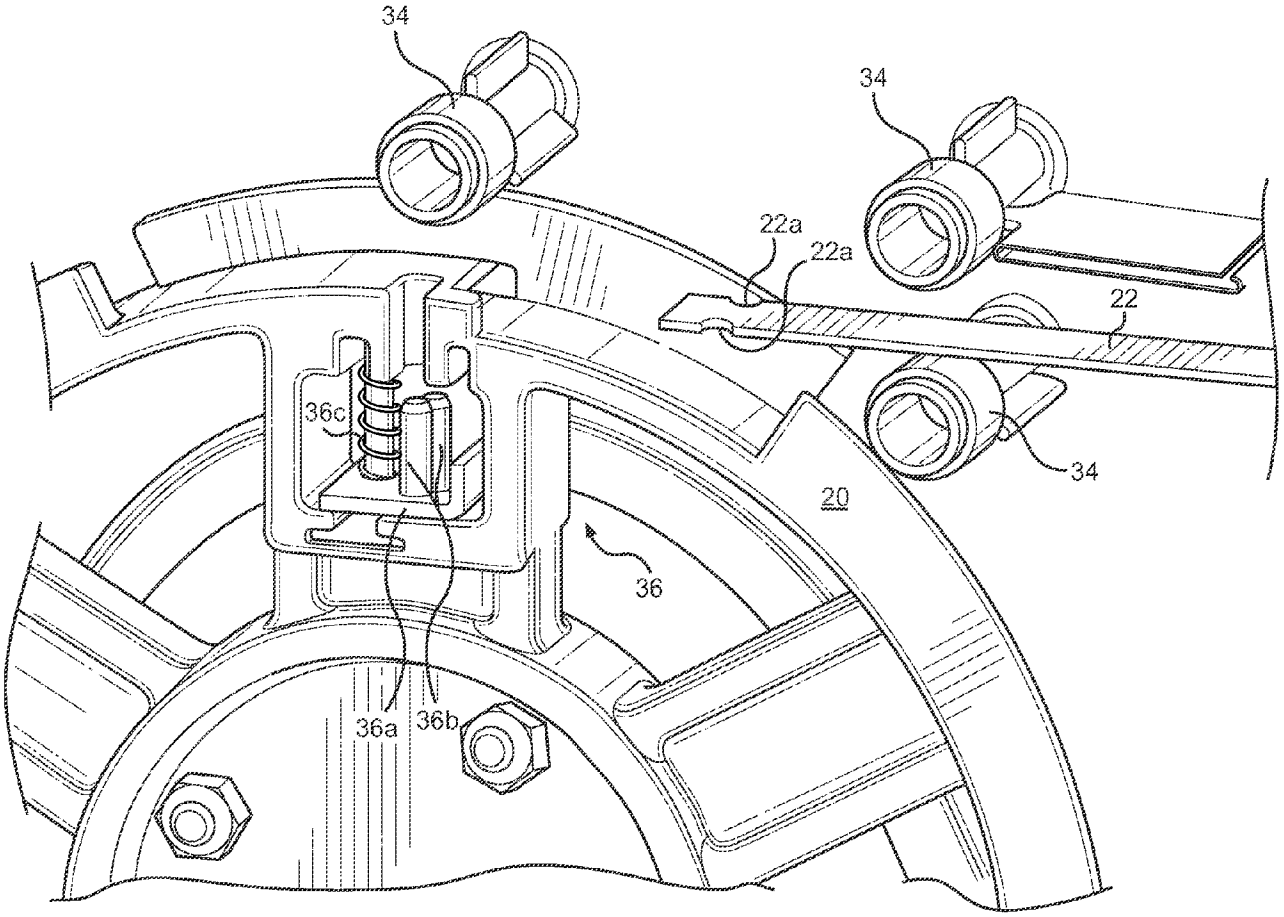
FIG. 6 is a fragmentary perspective view of a steel tape reel in open position for change of tape.
Figure 7:
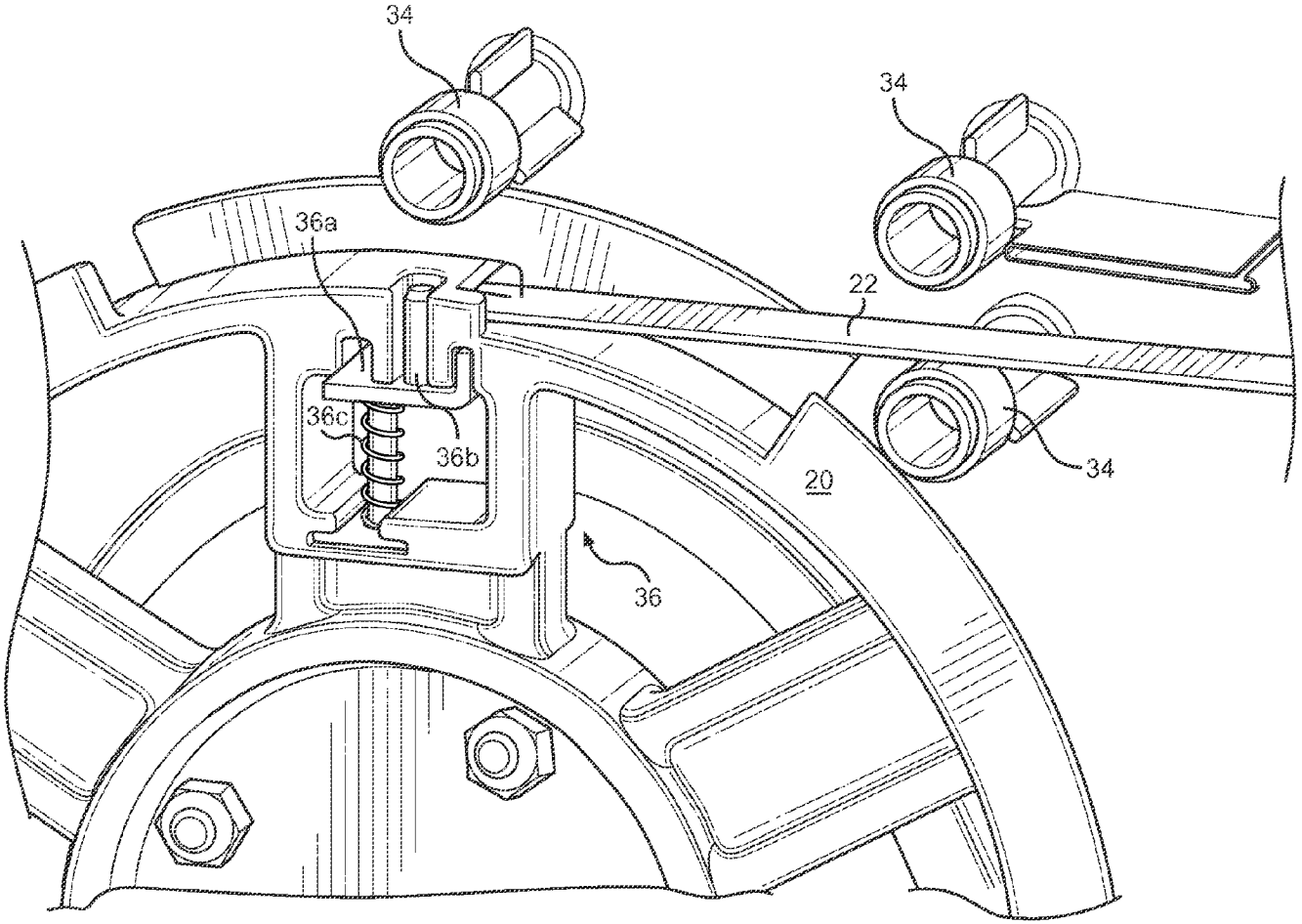
FIG. 7 is a fragmentary perspective view of a steel tape reel in closed position for tape operation in tube cleaning.

FIG. 6 and FIG. 7 show tape reel or drum 20 for forward unwinding and reverse rewinding of tape 22 for cleaner operation. Tape 22 may comprise a stainless steel band having strength and stiffness capable of pushing tube cleaning brush assembly 24 described herein through the length of a fire-tube 28, of pulling the brush assembly 24 back through the tube 28 in a cleaning stroke, and having a suitable level of pliability to coil about the tape reel 20. While typical fire-tube cleaning tape (not shown) must be designed of a sufficient width and thickness to provide approximately two hundred (200) pounds of push force, for example, the tape 22 in accordance with embodiments herein may generally be about half the width and thinner than typical tape, such that the tape 22 of the fire-tube cleaning machine 10 described herein may be designed and configured to maintain structural integrity upon an application of approximately one hundred (100) pounds of push-force. In such a manner, for example, the tape 22 may be approximately one half the weight of typical tapes, significantly reducing the overall wright of the fire-tube cleaning machine 10 as compared to previous cleaning machines for fire-tubes.

In some embodiments, on reverse stroke the reel stop 20*c* positions tape notches 22*a* adjacent access panel 12*d*. Tape 22 has end notches 22*a* for engagement with a movable anchor 36 fitted to the reel 20. A spring loaded platform 36*a* positions anchor pins 36*b* in engagement with notches 22*a* for securing tape 22 to reel 20. Platform 36*a* is lowered to disengage pins 36*b* from notches 22*a* when tape 22 is replaced. Spring 36*c* urges platform 36*a* and pins 36*b* into normal position of anchoring pins 36*b* to tape notches 22*a*. Cover plate 12*d* (FIG. 1 and FIG. 3) provides access to platform 36*a* and tape notches 22*a* so that tape 22 can be changed without dismantling the cleaner housing 12. Rollers 34 remove binding friction on the tape 22 when outward bound into a tube 28.

Figure 8:
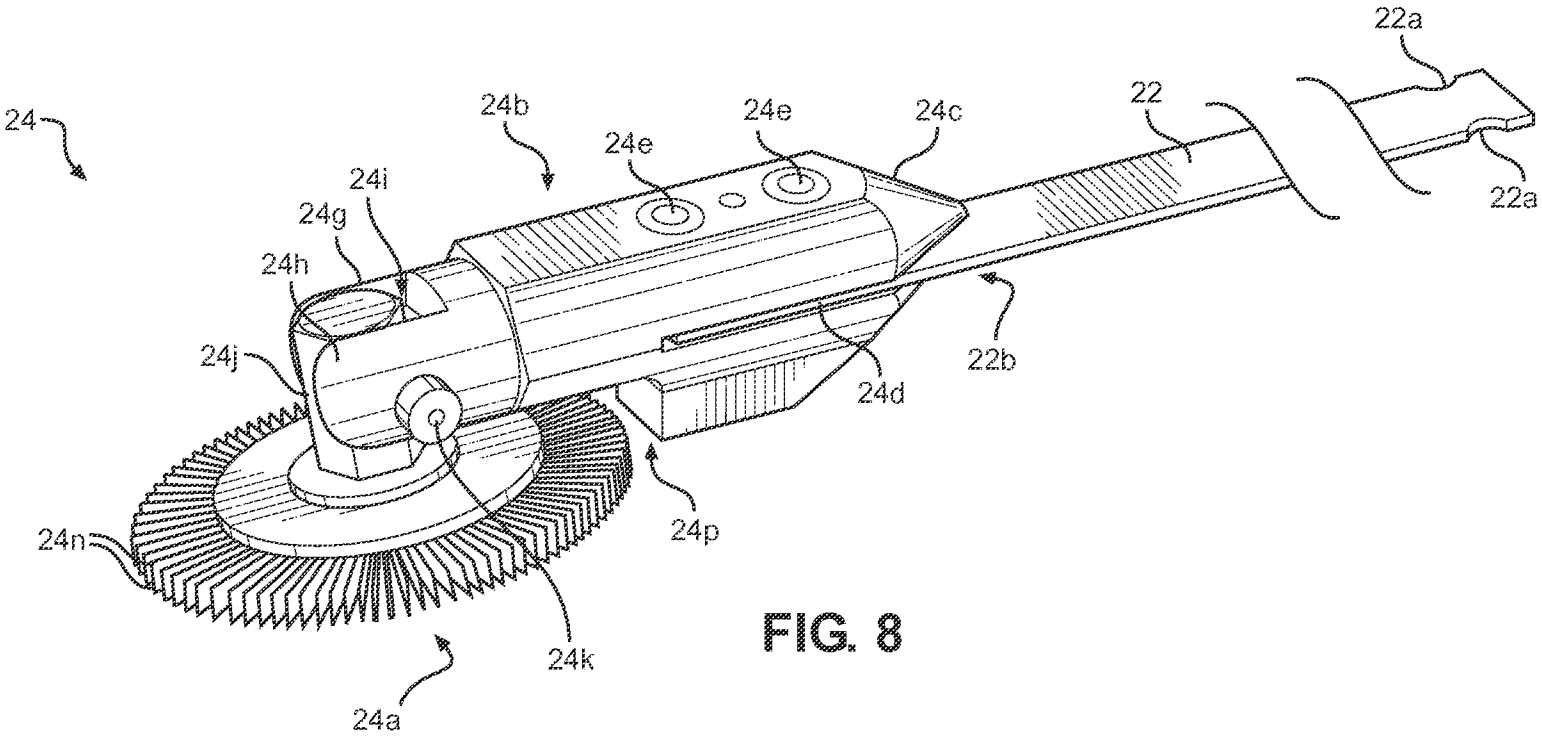
FIG. 8 is a perspective view of a cleaning brush in a position for feeding into a fire-tube on forward stroke.
Figure 9:
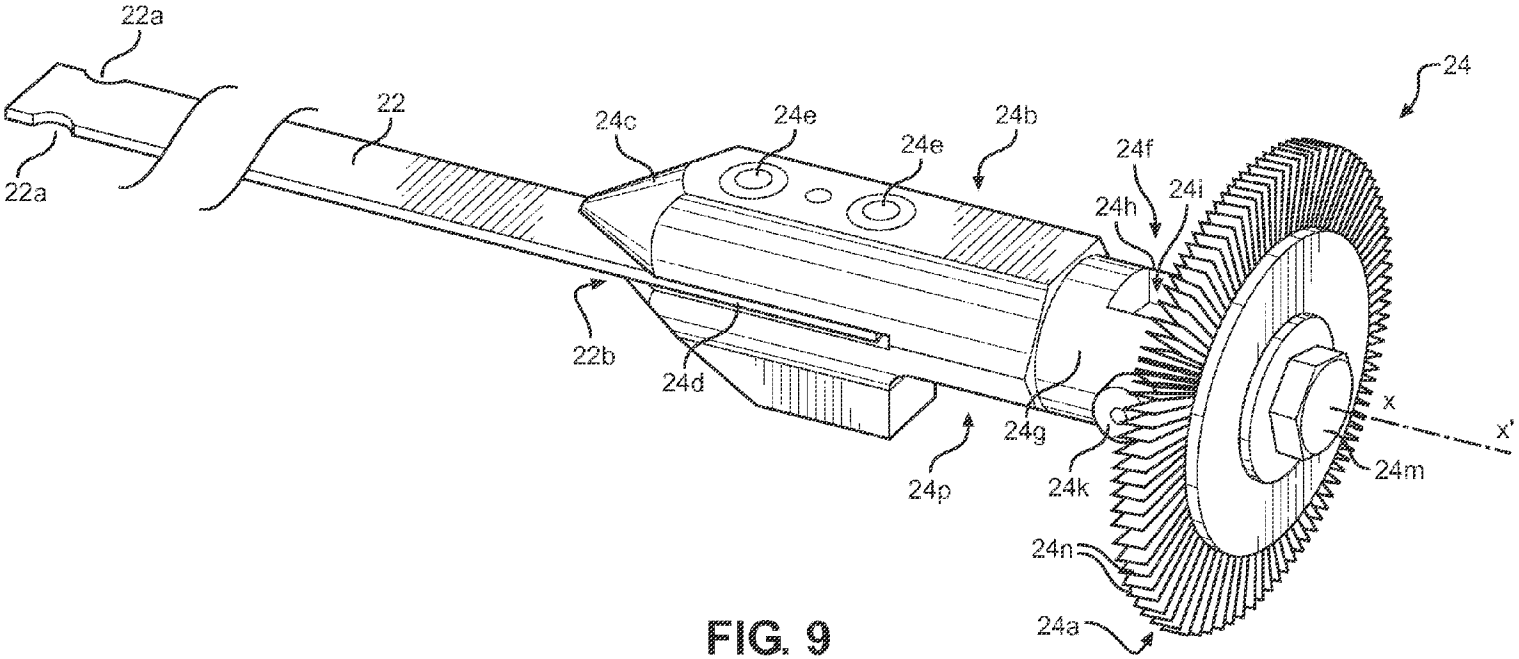
FIG. 9 is a perspective view of a cleaning brush in a position for cleaning a fire-tube on return stroke.

FIG. 8 and FIG. 9 illustrate brush assembly 24 of cleaning brush 24*a* and brush head 24*b*. Cleaning brush 24*a* is attached to tape 22 by means of brush head 24*b*. Brush head 24*b* comprises an elongate block 24*c* with center recess 24*d* for insertion and securing tape end 22*b* to the block 24*c* using suitable fasteners 24*e*. Block end 24*f* has spaced arms 24*g-h* defining between them a socket 24*i* for receiving cleaning brush subassembly of brush 24*a* and brush post 24*j*. Brush post 24*j* is nested within socket 24*i* and secured to arms 24*g-h* by pivot pin 24*k* for pivotal movement of brush 24*a* and brush post 24*j* from horizontal to vertical positions of FIG. 8 and FIG. 9, respectively. Brush subassembly has normal position as shown in FIG. 8, and sets up to vertical position when tape 22 is in reverse stroke pulling brush 24*a* through a fire tube 28. The brush 24*a* itself is mounted by securing bolt 24*m* on brush post 24*j* for free-wheeling rotation about brush axis X-X'. In some embodiments, the term "vertical" may be descriptive of (and/or specifically defined as) the brush 24*a* being oriented such that a centerline of the securing bolt 24*m* (not separately labeled) is oriented along the X-X' axis. According to some embodiments, the term "horizontal" may be descriptive of (and/or specifically defined as) the brush 24*a* being oriented such that the centerline of the securing bolt 24*m* (not separately labeled) is oriented perpendicular to the X-X' axis.

The brush 24*a* includes cleaning strips or blades 24*n* of suitable material extending radially from brush axis X-X'. The brush strips 24*n* may be pitched at an angle to brush axis X-X' to promote rotation and cleaning action of the brush 24*a* as it travels in reverse stroke through a fire-tube 28.

The underside of brush head 24*b* defines a recess 24*p* to accommodate positioning of the brush 24*a* horizontally (FIG. 8). The tape 22 and brush assembly 24 are in position of FIG. 8 on forward stroke for pushing brush 24*a* through a fire-tube 28 to initiate cleaning operation. For a reverse stroke or cleaning pass, the tape 22 pulls brush 24*a* back through a fire-tube 28. In this cleaning pass, the brush 24*a* pivots to vertical (FIG. 9) with brush tips (not separately labeled) engaging interior fire-tube surface (not shown) while rotating and scrubbing soot and other dirt and contaminants (not shown) from the tube 28. A vacuum source (not shown) secured to machine vacuum connection 12*e* draws scrubbed material (not shown) from fire-tube 28 through machine barrel 26.

In use of the fire-tube cleaning machine 10, an operator sets distance indicator 30 according to fire-tube length for a particular boiler (not shown). With brush assembly 24 in position of FIG. 8, operator advances the brush assembly 24 in a forward stroke by reeling out the tape 22 the set distance. Diametrically opposed edges of brush blades 24*n* slip along interior fire-tube surface with minimum resistance. Here the chief requirement of the machine 10 is for a tape 22 of sufficient strength to push against this minimum resistance. The need for a massive conventional machine to support a forward stroke cleaning pass is eliminated. For cleaning the fire-tube 28, the tape 22 is pulled through reverse stroke with brush assembly 24 setting up to position of FIG. 9 with entire complement of blade tips scrubbing tube interior. On the reverse pass, the boiler (not shown) provides mass and cleaning machine 10 provides light-weight, high strength structure for pulling brush 24*a* back through each tube 28.

Various changes may be made to the structure embodying the principles of the embodiments described herein without deviating from the scope of the overall invention. The foregoing embodiments are set forth in an illustrative and not in a limiting sense. The foregoing description has particular reference to cleaning boiler fire-tubes, however, it is understood that the cleaning machine described herein may be used for a wide variety of tube cleaning applications.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A tube cleaner comprising, a machine housing defining space for mounting a tape reel, a tape attached to the tape reel for forward and reverse movement of the tape through a length of a tube, a drive train for imparting forward and reverse movement to the tape reel and the tape, the machine housing having a tape outlet member for directing the tape into the tube, means for removably securing a first end of the tape to the tape reel, a brush assembly attached to a second and opposite end of the tape, the brush assembly comprising a brush head, means for securing the second end of the tape to the brush head, the brush head comprising a brush subassembly comprising a brush and a brush post secured to the brush head, the brush subassembly having a first normal position wherein the brush encounters minimum resistance between the brush and an interior surface of the tube on forward movement of the tape and the brush through the tube, the brush subassembly having a second cleaning position wherein the brush fully engages and cleans the interior surface of the tube on reverse movement of the tape and the brush through the tube, and the brush head comprising an end socket, the brush post nested in the end socket and secured in the end socket by a pivot pin so the brush is free to move from the first normal position to the second cleaning position.

2. A tube cleaner comprising, a machine housing defining space for mounting a tape reel, a tape attached to the tape reel for forward and reverse movement of the tape through a length of a tube, a drive train for imparting forward and reverse movement to the tape reel and the tape, the machine housing having a tape outlet member for directing the tape into the tube, anchor pins for removably securing a first end of the tape to the tape reel, an access panel in the machine housing for moving the anchor pins for disconnecting and reconnecting the tape to the tape reel, a brush assembly attached to a second and opposite end of the tape, the brush assembly comprising a brush head, means for securing the second end of the tape to the brush head, the brush head comprising a brush subassembly comprising a brush and a brush post secured to the brush head, the brush subassembly having a first normal position wherein the brush encounters minimum resistance between the brush and an interior surface of the tube on forward movement of the tape and the brush through the tube, the brush subassembly having a second cleaning position wherein the brush fully engages and cleans the interior surface of the tube on reverse movement of the tape and the brush through the tube, and the brush head comprising an end socket, the brush post nested in the end socket and secured in the end socket by a pivot pin so the brush is free to move from the first normal position to the second cleaning position.

3. A tube cleaner comprising, a machine housing defining space for mounting a tape reel, a tape attached to the tape reel for forward and reverse movement of the tape through a length of a tube, a drive train including a drive motor for imparting forward and reverse movement to the tape reel and the tape, the machine housing having a tape outlet member for directing the tape into the tube, means for removably securing a first end of the tape to the tape reel, a brush assembly attached to a second and opposite end of the tape, the brush assembly having a first normal position wherein a brush of the brush assembly encounters minimum resistance between the brush and an interior surface of the tube on forward movement of the tape and the brush assembly through the tube, the brush assembly having a second cleaning position wherein the brush fully engages and cleans the interior surface of the tube on reverse movement of the tape and the brush through the tube, a distance indicator for matching the distance of forward movement of the brush assembly with length of the tube, the distance indicator powered by the drive train, the distance indicator having an adjustable actuator cooperating with a first switch means for stopping the drive train when the brush assembly forward movement matches the length of the tube, the distance indicator having a fixed actuator cooperating with a second switch means for stopping the drive train when the brush assembly reverse movement withdraws the brush assembly from the tube.

4. A tube cleaner as defined in claim 3 further comprising, a main switch enabling an operator to determine forward, reverse, and stop positions of the drive motor.

* * * * *